United States Patent [19]

Day et al.

[11] Patent Number: 4,809,606

[45] Date of Patent: Mar. 7, 1989

[54] OSCILLATING FORM ROLLER AND APPARATUS AND METHOD FOR CONTROLLING THE OSCILLATION THEREOF

[75] Inventors: James R. Day, Plano; Milton R. Lemaster, Dallas, both of Tex.

[73] Assignee: Airsystems Inc., Dallas, Tex.

[21] Appl. No.: 64,226

[22] Filed: Jun. 19, 1987

[51] Int. Cl.[4] ..... B41F 7/26; B41F 31/14

[52] U.S. Cl. ..... 101/148; 101/349; 101/DIG. 14; 101/426

[58] Field of Search ..... 101/148, DIG. 14, 348, 101/349, 350, 426

[56] References Cited

U.S. PATENT DOCUMENTS

| | | | |
|---|---|---|---|
| 2,033,950 | 3/1936 | Morse | 101/DIG. 14 |
| 3,467,008 | 9/1969 | Domotor | 101/148 |
| 3,625,148 | 12/1971 | Muselik | 101/DIG. 14 |
| 3,983,812 | 10/1976 | Schramm | 101/349 |
| 4,170,176 | 10/1979 | Domeneniconi | 101/DIG. 14 |
| 4,295,423 | 10/1981 | Johne et al. | 101/DIG. 14 X |
| 4,485,737 | 12/1984 | Jeschroe | 101/148 |
| 4,577,556 | 3/1986 | Fischer | 101/148 |

*Primary Examiner*—J. Reed Fisher
*Attorney, Agent, or Firm*—W. Kirk McCord

[57] ABSTRACT

An apparatus and method for oscillating the dampening form roller in a lithographic printing press to provide a substantially uniform application of dampening fluid on the printing plate. The form roller is comprised of a rotatable shaft and a cylindrical roller concentrically disposed on the shaft. A double-ribbed barrel cam is coupled to the roller so as to be rotatable therewith and first and second cylindrical cam followers are disposed a predetermined distance apart on the shaft for receiving the cam therebetween so that a first major surface of the cam is in contact with the first cam follower and a second major surface of the cam is in contact with the second cam follower. The "rise and fall" of the cam as the cam rotates relative to the cam followers imparts an oscillating motion to the roller. The rate of oscillation is substantially the same as the rate of rotation of the cam relative to the cam followers. The rate of oscillation is controlled by means of first and second roller bearings which are proximately disposed on the shaft. By adjusting the frictional engagement between the respective inner and outer races of the bearings, the speed of the shaft is controlled. The greater the relative difference between the rotational speed of the roller and the rotational speed of the shaft, the greater will be the rate of oscillation because the cam will rotate at a greater speed relative to the cam followers. Conversely, a lesser relative rotational speed differential between the shaft and roller will result in a lesser rate of oscillation of the roller.

18 Claims, 5 Drawing Sheets

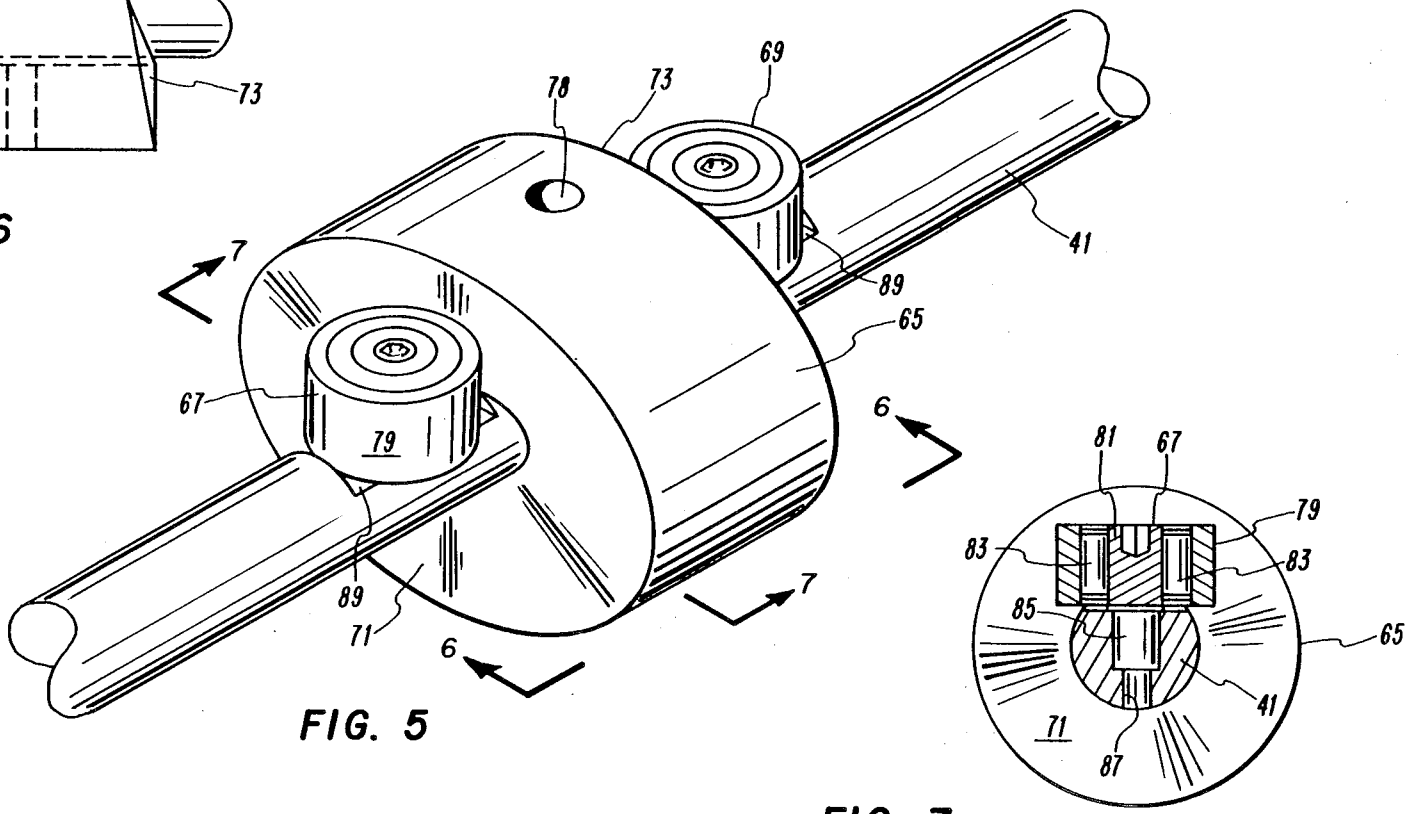
FIG. 7
FIG. 5
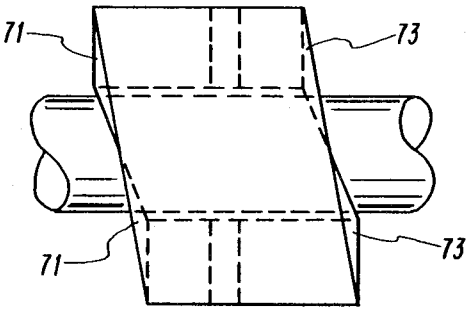
FIG. 6

OSCILLATING FORM ROLLER AND APPARATUS AND METHOD FOR CONTROLLING THE OSCILLATION THEREOF

FIELD OF THE INVENTION

The present invention relates generally to lithographic printing press systems and in particular to the dampening form rollers used in such printing press systems.

BACKGROUND OF THE INVENTION

In a lithographic printing press printing ink is transferred from an ink fountain or the like by a series of ink distribution rollers to the printing plate. Similarly, water or other dampening fluid is transferred from a pan or a sump by a series of dampening rollers to the printing plate. The particular dampening roller which actually applies the water or other fluid to the printing plate is known as the dampening form roller.

A common problem associated with lithographic printing presses is the problem of "railroad tracking". This problem occurs when the dampening form roller picks up ink from the printing plate, particularly when dry spots occur on the dampening form roller. Such dry spots are particularly susceptible to picking up printing ink. During the rotation of the dampening form roller, ink may be deposited on certain non-ink receptive areas of the plate cylinder, which results in ink streaks appearing on the final print product. Water streaks may also appear on the printing plate, which necessitates the use of alcohol and alcohol-substitutes in the dampening fluid to break up the surface tension of the water and reduce streaking.

DESCRIPTION OF THE PRIOR ART

According to prior practice, when "railroad tracking" occurs, the printing press must be stopped long enough to clean the dampening form roller to remove the ink. This is a cumbersome procedure and interrupts the printing operation. Large amounts of water or other dampening fluid are also needed to prevent dry spots from occurring on the dampening form roller. This not only increases the expense of the printing operation, but also increases the likelihood that water will become entrained in the ink, which will substantially reduce print quality.

Co-pending U.S. application Ser. No. 909,898 describes a dampening form roller which is allowed to oscillate along with the corresponding vibrator roller. The oscillation of the dampening form roller helps reduce ink streaking by smoothing out the dampening fluid on the surface of the form roller to eliminate dry spots. It has been found, however, that the dampening fluid reduces the drag exerted on the form roller by the vibrator roller to the extent that the form roller cannot be properly oscillated merely by the drag force exerted thereon by the oscillating motion of the vibrator roller. Other means must be provided to oscillate the form roller.

U.S. Pat. Nos. 3,983,812 and 4,493,257 describe apparatus for oscillating ink form rollers, but there is no teaching or suggestion in these references relating to the oscillation of dampening form rollers.

OBJECTS OF THE INVENTION

It is, therefore, the principal object of the present invention to provide an improved dampening form roller for a lithographic printing press.

Another object of the invention is to provide an improved apparatus and method for controlling the oscillation of the dampening form roller in a lithographic printing press.

Yet another object of the invention is to provide an apparatus and method for substantially eliminating the problem of "rairoad tracking" in a lithographic printing press.

Still another object of the invention is to provide an apparatus and method for providing a smooth, relatively uniform application of water or other dampening fluid to the printing plate in a lithographic printing press.

A further object of the invention is to improve the quality of the image printed by a lithographic printing press.

SUMMARY OF THE INVENTION

These and other objects are accomplished in accordance with the present invention. An apparatus for applying dampening fluid to selected areas of a printing plate in a lithographic printing press is provided. The apparatus is comprised of a shaft rotatable about its own axis; roller means concentrically disposed with respect to the shaft for contacting the printing plate to apply the dampening fluid to selected areas of the plate when the roller means is rotated about the axis of the shaft; cam means coupled to the roller means and being rotatable therewith about the axis of the shaft; cam follower means mounted on the shaft and being rotatable therewith; and means for controlling the speed of rotation of the shaft so that the roller means is rotatable at a selected rate relative to the shaft. The cam means is rotatable at the same selected rate relative to the cam follower means for engaging the cam follower means to oscillate the roller means axially with respect to the shaft at a rate which is substantially the same as the selected rate.

In one aspect of the invention the cam means is comprised of a barrel cam having first and second oppositely positioned contoured major surfaces and the cam follower means is comprised of first and second substantially cylindrical cam followers disposed a predetermined distance apart on the shaft for receiving the cam therebetween so that the first major surface is in contact with the first cam follower and the second major surface is in contact with the second cam follower. As the cam rotates relative to the cam followers, the contoured first and second major surfaces impart an oscillating motion to the roller means, the rate of oscillation being substantially the same as the relative rate of rotation of the roller means with respect to the shaft.

In another aspect of the invention, the means for controlling the rotational speed of the shaft is comprised of roller bearing means having an inner race, an outer race and a plurality of tapered rollers interposed between the inner and outer races. The roller bearing means is concentrically disposed on the shaft so that the inner race is in contact therewith and is rotatable along with the shaft. The outer race is fixed against rotation. Means is provided for adjusting the frictional engagement between the inner and outer races so that the speed of rotation of the shaft is inversely proportional to the magnitude of such frictional engagement.

In the preferred embodiment the roller bearing means is comprised of first and second roller bearings proximately disposed adjacent to a first end of the shaft and the means for adjusting the frictional engagement between the inner and outer races of each of the bearings is comprised of a rotatable member threadedly connected to the shaft at the first end thereof and a washer member sandwiched between the rotatable member and the inner race of the first roller bearing. The rotation of the rotatable member in a first direction increases the frictional engagement between the respective inner and outer races of each of the first and second roller bearings to reduce the rotational speed of the shaft relative to the roller means, thereby increasing the rate of oscillation of the roller means. The rotation of the rotatable member in a second direction, opposite from the first direction, decreases the frictional engagement between the respective inner and outer races of each of the first and second roller bearings to increase the rotational speed of the shaft relative to the roller means, thereby decreasing the rate of oscillation of the roller means.

The rotatable member is preferably comprised of an elongated threaded bolt with an hexagonal head at one end thereof for being engaged by a wrench or the like to selectively rotate the threaded bolt inside of the shaft. First and second hubs are disposed on respective first and second ends of the shaft for mounting the apparatus on a lithographic printing press. The first hub has an internal chamber therein in which the first and second roller bearings and threaded bolt are disposed. The first hub is fixed against rotation, while the second hub is rotatable along with the shaft. First and second linear rotary bearings are interposed between the roller means and the shaft to allow the roller means to rotate and move axially relative to the shaft.

BRIEF DESCRIPTION OF THE DRAWINGS

Other aspects and features of the invention will be apparent from the detailed description and claims when read in conjunction with the accompanying drawings wherein:

FIG. 5 is a perspective view of the cam and cam follower used in connection with the present invention;

FIG. 6 is an end view of the cam shown in FIG. 5; and

FIG. 7 is a sectional view of one of the cam followers, taken along the line 7—7 in FIG. 5.

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
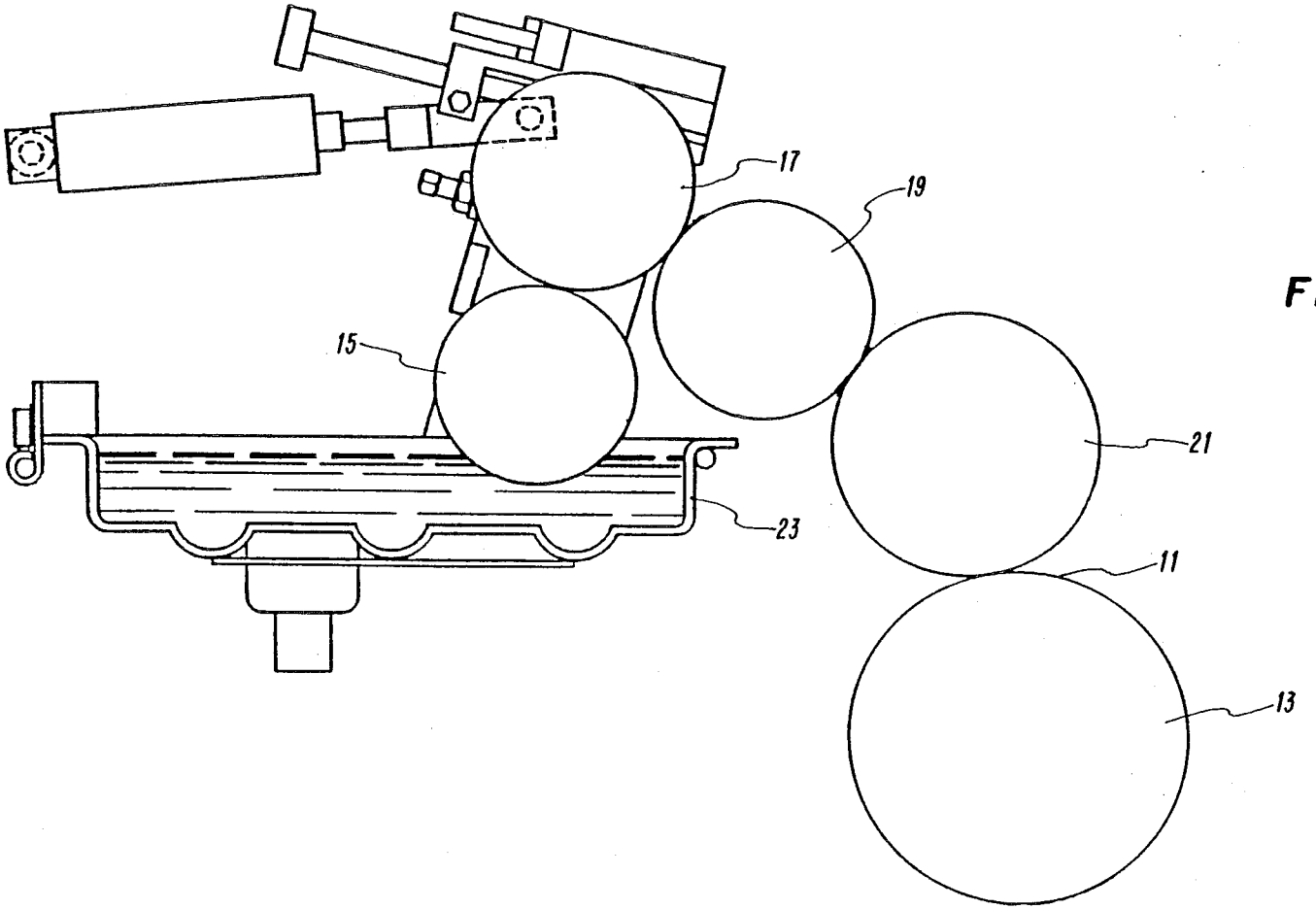
FIG. 1 is a schematic illustrating the dampening roller system in a lithographic printing press.
Figure 2:
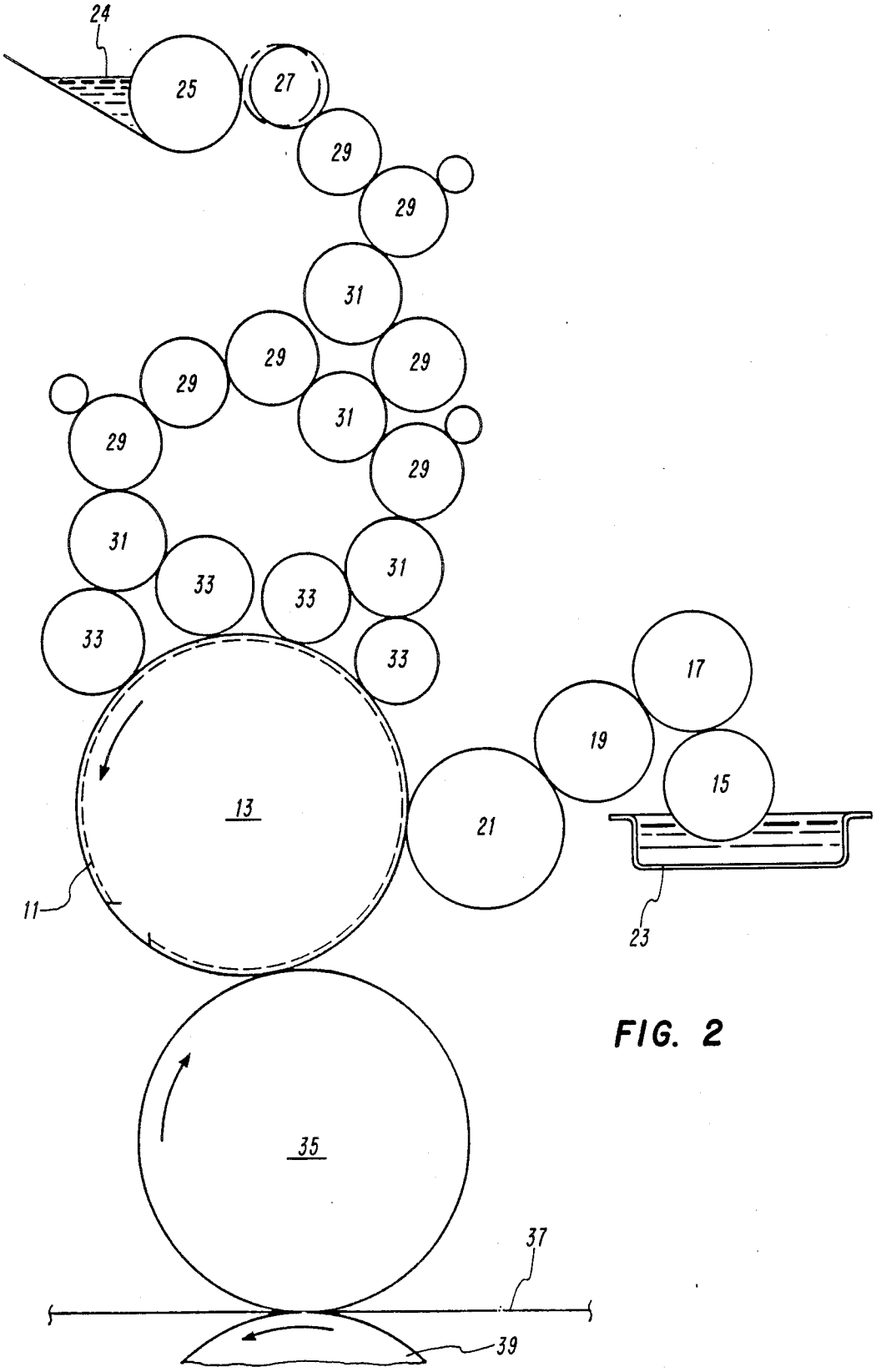
FIG. 2 is a schematic illustrating the ink rollers and dampening rollers in contact with the printing plate in a lithographic printing press.

Referring to FIGS. 1 and 2, the respective systems for applying ink and dampening fluid to selected areas of a printing plate in a lithographic printing press are depicted. One skilled in the art will recognize that printing plate 11 is disposed on a substantially cylindrical plate cylinder 13 and includes discrete ink-receptive areas and non-ink-receptive areas on the surface thereof.

The non-ink-receptive areas of printing plate 11 are covered with a dampening solution, such as water, applied by a series of water rollers. The water roller system is preferably comprised of a pan roller 15, a metering roller 17, a vibrator roller 19 and a dampening form roller 21. Pan roller 15 picks up water or other dampening fluid from a pan or a sump 23, transfers it to metering roller 17, which it in turn transfers the water to vibrator roller 19 and then in turn to dampening form roller 21, which deposits water on the non-ink-receptive areas of printing plate 11.

A series of ink distribution rollers is used to apply printing ink to the ink-receptive areas of printing plate 11. The ink distribution system includes an ink fountain roller 25, a ductor roller 27, seven distributor rollers 29, four vibrating rollers 31 and four ink form rollers 33. Each of the four ink form rollers 33 is in contact with printing plate 11 at any given time at respective discrete positions along the circumference thereof for transferring printing ink to the in-receptive areas of printing plate 11. Printing plate 11 is also in contact with first blanket cylinder 35, which transfers the image to be imprinted to sheet 37 as sheet 37 passes between blanket cylinder 35 and back cylinder 39. The respective directions of rotation the plate cylinder 13, blanket cylinder 35 and back cylinder 39 are indicated in FIG. 2. Sheet 37 is moved through the printing press from left to right, as viewed in FIG. 2.

When the printing press is in operation, all of the aforementioned ink and water rollers are rotated about their respective axes to transfer printing ink from ink fountain 24 to printing plate 11 and also from sump 23 to printing plate 11. Furthermore, vibrator roller 19 and each ink vibrating roller 31 have a conventional drive system, which may include an electric drive motor and worm gear mechanism, associated therewith for moving the corresponding roller back and forth in an axial direction. Such drive mechanisms are conventional and will not be described herein because they do not form a part of the present invention. The axial movement of vibrator roller 19 and vibrating rollers 31 serves to smooth out the dampening fluid and ink, respectively, on dampening form roller 21 and on ink form rollers 33. Rotational motion is imparted to dampening form roller 21 by vibrator roller 19 and rotational motion is imparted to ink form rollers 33 by vibrating rollers 31.

In accordance with the present invention, an apparatus is provided for moving dampening form roller 21 axially within predetermined limits. It has been found that the dampening fluid substantially reduces the drag exerted on dampening form roller 21 by the oscillating motion of vibrator roller 19, such that the axial movement of vibrator roller 19 will not impart sufficient axial movement to dampening form roller 21. It is desirable to oscillate dampening form roller 21 in order to smooth out the dampening fluid thereon, eliminate dry spots and reduce the amount of dampening fluid used. Dry spots on dampening form roller 21 are particularly troublesome because these spots are susceptible to picking up printing ink from printing plate 11 and depositing such ink on non-ink-receptive areas of plate 11, which results in ink streaking, railroad tracking and the like.

Figure 3:
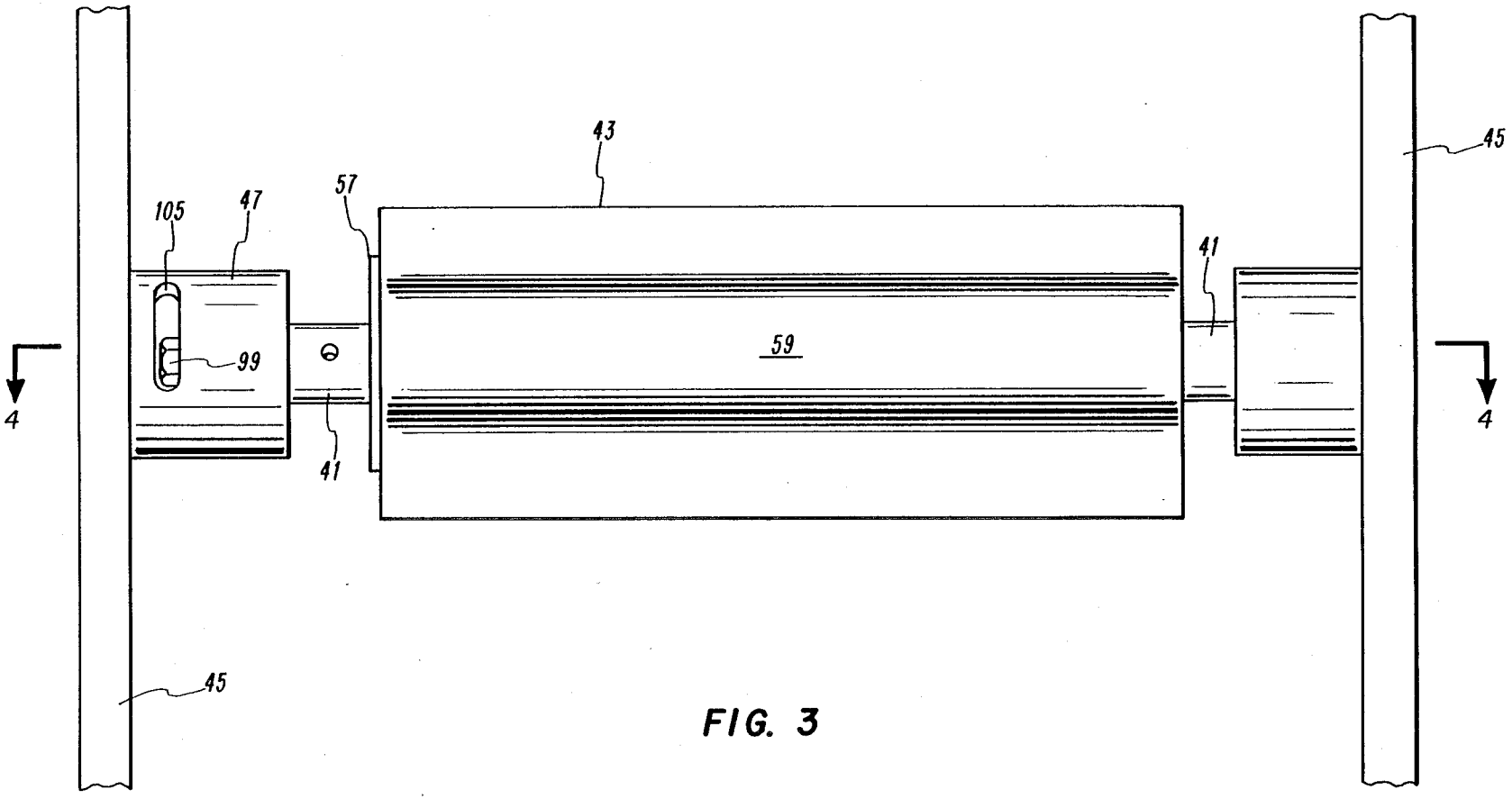
FIG. 3 is an elevation view of the dampening form roller according to the present invention.
Figure 4:
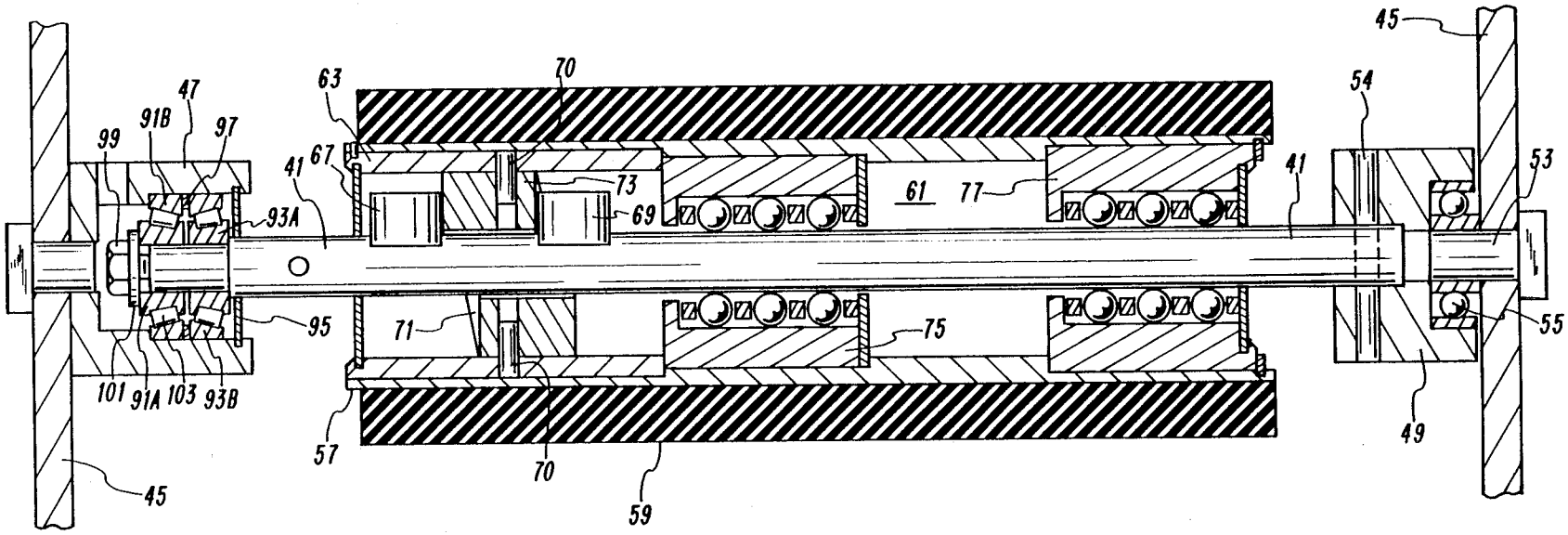
FIG. 4 is a sectional view of the dampening form roller, taken along the line 4—4 in FIG. 3.

Referring to FIGS. 3 and 4, dampening form roller 21 is comprised of an elongated metal shaft 41, which is rotatable about its own axis, and hollow cylindrical roller member 43, which is open at both ends thereof and is concentrically disposed around shaft 41. Dampening form roller 21 is suspended between opposed walls 45 of the printing press by means of first and second hubs 47 and 49 which are disposed on respective opposite ends of shaft 41. First and second mounting pins 51 and 53 extend through corresponding openings in respective first and econd hubs 47 and 49 for journally supporting dampening form roller 21 in a fixed position relative to walls 45 of the printing press. First hub 47 is fixed against rotation, while second hub 49 is pinned to shaft 41, as indicated at 54, so as to be rotatable therewith. A ball bearing 55 is interposed between second pin member 53 and second hub 49 for allowing second hub 49 to rotate with respect to second pin member 53.

In one aspect of the invention, dampening form roller 21 includes means for oscillating roller member 43 axially with respect to shaft 41. Roller member 43 has a hollow metal cylinder 57 surrounded by cylindrical rubber covering 59. A cylindrical chamber 61 is defined within metal cylinder 57. Disposed within chamber 61 adjacent to a first end of roller member 43 is a substantially cylindrical sleeve member 63. Sleeve member 63 is pressed fit into chamber 61 so as to frictionally engage metal cylinder 57 and hold sleeve member 63 securely in position within chamber 61.

Disposed inside of sleeve member 63 is a cam 65 and first and second follows 67 and 69. Cam 65 is pinned to sleeve member 63, as indicated at 70 and first and second cam followers 67 and 69 are mounted in a fixed position on shaft 41. Cam 65 is rotatable along with sleeve member 63 and roller member 43 and first and second cam followers 67 and 69 are rotatable along with shaft 41. Cam 65 is preferably a double-ribbed barrel cam having oppositely positioned contoured major surfaces 71 and 73, which engage respective first and second cam followers 67 and 69. The rotational motion of roller member 43 is transmitted by cam 65 to cam followers 67 and 69 to impart rotational motion to shaft 41. The operation of cam 65 and cam followers 67 and 69 will be described in greater detail with reference to FIGS. 5–7.

Also disposed within chamber 61 are first and second linear rotary bearings 75 and 77. Linear rotary bearings 75 and 77 are concentrically disposed around shaft 41 and are coupled to roller member 43 so as to be rotatable therewith around shaft 41. In addition to allowing roller member 43 to rotate relative to shaft 41, linear rotary bearings 75 and 77 also allow roller member 43 to move axially with respect to shaft 41. Linear rotary bearings 75 and 75 are preferably of the type described and claimed in U.S. Pat. No. 4,025,128.

Referring also to FIGS. 5–7, first and second major surfaces 71 and 73 are contoured such that the difference between the respective high and low points on each major surface is on the order of 400 mils (such difference is commonly referred to as the "rise and fall" of the cam). One skilled in the art will appreciate that as cam 65 rotates along with roller member 43 relative to shaft 41 and cam followers 67 and 69, first and second major surfaces 71 and 73 will contact respective first and second cam followers 67 and 69 to impart an oscillating motion to roller member 43 relative to shaft 41. The frequency of the oscillation is substantially the same as the relative difference in the respective rotational speeds of shaft 41 and roller member 43. In FIGS. 5 and 6, the high point of first major surface 71 is in engagement with first cam follower 67 and the corresponding low point of second major surface 73 is in engagement with second cam follower 69, such that roller member 43 is at the far right limit of its travel as viewed in FIGS. 5 and 6.

Referring also to FIG. 4, one skilled in the art will recognize that roller member 43 is also at the far right limit of its axial movement. As cam 65 continues to rotate, the first major surface 71 will "fall off" and second major surface 73 will "rise" so that after one-half revolution of cam 65, the situation is reversed (i.e., the high point of second major surface 73 is in engagement with second cam follower 69 and the corresponding low point of first major surface 71 is in engagement with first cam follower 67). At this point, roller member 43 is at the far left limit of its axial movement. Thus, the rise and fall of major surfaces 71 and 73 of cam 65 as it is rotated relative to first and second cam followers 67 and 69 imparts the oscillating motion to roller member 43. Roller member 43 will oscillate a total distance of approximately 400 mils between the far left and far right limits.

One skilled in the art will recognize that linear rotary bearings 75 and 77 are positioned so as not to interfere with the oscillation of roller member 43. As such, first linear rotary bearing 75, which is positioned between sleeve member 63 and second linear rotary bearing 77, must be positioned far enough away from second cam follower 69 to allow roller member 43 to oscillate freely. For example, in FIG. 4 the spacing between second cam follower 69 and first linear rotary bearing 75 when roller member 43 is at its far right limit must be at least 400 mils to permit roller member 43 to move 400 mils back toward the far left limit. Cam 65 includes a pair of aligned openings 78 (only one of which is shown in FIG. 5) for pinning cam 65 to sleeve member 63, as indicated at 70 in FIG. 4.

Referring to FIG. 7, first cam follower 67 is shown in cross-section. The cylindrical portion of cam follower 67 includes an outer portion 79, an inner portion 81 and needle bearins 83 interposed between inner and outer portions 79 and 81 for allowing outer portion 79 to rotate with respect to inner portion 81. Beneath the cylindrical portion of cam follower 67 is a stud 85, which is pressed fit into a complementary opening 87 extending radially at least partially through shaft 41. Opening 87 is narrowed to define a shoulder for preventing stud 85 from extending all the way through shaft 41. Furthermore, the narrow portion of opening 87 is used to receive a tap or other suitable tool for removing cam follower 67 from its mounted position on shaft 41. Cam followers 67 and 69 are preferably receive within recessed regions 89 on shaft 41, as best seen in FIG. 4, to further secure first and second cam followers 67 and 69 on shaft 41 and to ensure sufficient clearance between the respective tops of cam followers 67 and 69 and the inner surface of sleeve member 63, as best seen in FIG. 4.

Referring again to FIG. 4, another aspect of the invention is illustrated. It is advantageous to be able to control the speed of oscillation of roller member 43 with respect to shaft 41 because the optimum oscillation speed may vary depending upon the type of printing press, the speed of the press, the color of ink being used for a particular printing job and other factors. One skilled in the art will recognize that the speed of oscillation of roller member 43 is a function of the relative speed of rotation of cam 65 and roller member 43 with respect to cam followers 67 and 69 and shaft 41. If shaft 41 rotates at exactly the same speed as roller member 43, cam 65 does not rotate relative to cam followers 67 and 69 and hence there is no oscillation.

The speed of oscillation is controlled by regulating the rotational speed of shaft 41. This is accomplished by positioning first and second roller bearings 91 and 93 adjacent to a first end of shaft 41. First and second roller bearings 91 and 93 are preferably received within first hub 47. Each roller bearing 91 and 93 is comprised of an inner race, which is concentrically disposed on shaft 41 so as to be rotatable therewith, an outer race fixed against rotation and a plurality of tapered rollers interposed between the inner and outer race of each bearing. Shaft 41 is narrowed in the vicinity of second roller bearing 93 to provide a shoulder to prevent inner race 93*a* of second roller bearing 93 from being moved axially along shaft 41. A relatively flat plate 95 having an opening for receiving shaft 41 therethrough provides an effective seal for first hub member 47. A spacer member 97 is interposed between respective outer races 91*b* of first roller bearing 91 and 93*b* of second roller bearing 93 to stabilize the outer races so that outer races 91*b* and 93*b* in effect function as a single stationary outer race.

The first end of shaft 41 has a threaded opening therein (not shown) for receiving the shaft (not shown) of a threaded bolt member. The bolt member includes a hexagonal head 99 on one end having a substantially greater diameter than the shaft of the bolt member. Sandwiched between head 99 and inner race 91*a* of first roller bearing 91 is a relatively flat washer member 101. If the conventional right-handed threads are used to provide the threaded engagement between the bolt member and the threaded opening in the shaft, the rotation of head 101 in a clockwise direction, when viewed from left to right in FIG. 4, will exert an axially directed force from left to right on inner race 91*a*. Because of the taperred contours of inner race 91*a*, the left to right axial movement of inner race 91*a* will tend to compress rollers 103 between inner and outer races 91*a* and 91*b* of first roller bearing 91. This compressive force exerted on rollers 103 increases the frictional engagement vetween inner and outer races 91*a* and 91*b*. The force is also transmitted from outer race 91*b* through spacer member 97 to outer race 93*b*. Because inner race 93*a* is constrained from moving axially by the shoulder portion of shaft 41, the reactive force exerted by inner race 93*a* will compress rollers 103 between inner and outer races 93*a* and 93*b*, thereby increasing the frictional engagement between inner and outer races 93*a* and 93*b*. The next effect is that an increased frictional force is exerted on shaft 41 to slow down the rotation of shaft 41 relative to roller member 42. The more shaft 41 slows down the greater will be the relative rotational speed difference between shaft 41 and roller member 43 and hence the greater will be the rate of oscillation of roller member 43 relative to shaft 41 because of the commensurately increased rotational speed of cam 65 relative to cam followers 67 and 69.

Conversely, if it is desired to slow the oscillation of roller member 43, the bolt member is turned in a counter-clockwise direction as viewed from left to right in FIG. 4 to reduce the compressive force exerted on the roller bearings and the corresponding frictional force on shaft 41. This results in an increased rotational speed of shaft 41 and a decreased relative speed of rotation of roller member 43 and cam 65 relative to shaft 41 and cam followers 67 and 69 and a commensurately decreased rate of oscillation of roller member 43. It is assumed that roller member 43 will be rotated at a relatively constant speed (i.e., the speed of the printing press).

Referring again to FIG. 3, first hub member 47 includes an elongated elliptical slot 105 through which head 99 is accessible. Thus, the operator is able to insert a box wrench or the like through slot 105 to engage hexagonal head 99 for rotating the bolt member as necessary to control the rate of oscillation of roller member 43.

One skilled in the art will appreciate that the dampening form roller according to the present invention provides a self-oscillating dampening form roller, whereby the oscillating motion is imparted by the rotation of the form roller relative to its shaft. By controlling the rate of oscillation of the form roller, the printing press operator can determine the optimum rate of oscillation for the particular job at hand, while minimizing wear and tear on the equipment resulting from excessively high oscillation rates.

Various embodiments of the invention have been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. An apparatus for applying dampening fluid to selected areas of a printing plate in a lithographic printing press, comprising:

a shaft rotatable about its own axis;

roller means concentrically disposed with respect to said shaft, said roller means having a substantially cylindrical outer surface for contacting said printing plate to apply said dampening fluid to said selected areas when said roller means is rotated about the axis of the shaft;

cam means coupled to said roller means and being rotatable therewith about the axis of the shaft;

cam follower means mounted on said shaft and being rotatable therewith;

means for controlling the speed of rotation of said shaft so that roller means is rotatable at a selected rate relative to the shaft, said cam means being rotatable at said selected rate relative to said cam follower means for engaging said cam follower means to oscillate said roller means axially with respect to said shaft at a rate which is substantially the same as said selected rate, said means for controlling the rotational speed of the shaft being comprised of roller bearing means having an inner race, an outer race and a plurality of tapered rollers interposed between said inner race and said outer race, said roller bearing means being concentrically disposed on said shaft so that the inner race is in contact with the shaft and is rotatable therewith and said outer race is fixed against rotation, and means for adjusting the frictional engagement between the inner race and outer race of the roller bearing means, the speed of rotation of the shaft being inversely proportional to the magnitude of said frictional engagement.

2. The apparatus according to claim 1 wherein said cam means is comprised of a barrel cam having first and second oppositely positioned contoured major surfaces and said cam follower means is comprised of first and second substantially cylindrical cam followers disposed a predetermined distance apart on said shaft for receiving the cam therebetween so that the first major surface is in contact with the first cam follower and the second major surface is in contact with the second cam follower, said first and second major surfaces for being rotated relative to the respective first and second cam followers to move said roller means alternately in first and second opposite directions.

3. The apparatus according to claim 2 wherein said cam is a double-ribbed barrel cam.

4. The apparatus according to claim 1 wherein said roller means is comprised of an elongated cylindrical roller having a central opening extending between first and second opposite ends thereof.

5. The apparatus according to claim 4 wherein said cam means and said cam follower means are disposed within said central opening of said roller.

6. The apparatus according to claim 4 further including a sleeve member disposed within said central opening adjacent to a first end thereof, said cam means and said cam follower means being disposed within said sleeve member, said sleeve member being coupled between said roller and said cam means to transmit the rotary motion of said roller to said cam means.

7. The apparatus according to claim 4 further including linear rotary bearing means concentrically disposed on said shaft and attached to said roller within said central opening for journally supporting said roller on said shaft and for allowing said roller to rotate and move axially with respect to said shaft, said linear rotary bearing means being rotatable and axially moveable along with said roller.

8. The apparatus according to claim 7 wherein said linear rotary bearing means is comprised of first and second linear rotary bearings disposed within said central opening, said cam and cam follower means being disposed adjacent to said first end of said roller, said first linear rotary bearing being disposed adjacent to said second end of said roller and said second linear rotary bearing being disposed between said first linear rotary bearing and said cam and cam follower means.

9. The apparatus according to claim 1 further including first and second hubs disposed at respective first and second opposite ends of the shaft for mounting said apparatus on said printing press, said first and second hubs having respective first and second openings therein for receiving a complementary member to journally support said apparatus on said printing press.

10. The apparatus according the claim 1 wherein said roller bearing means is comprised of first and second roller bearings proximately disposed adjacent to a first end of said shaft and said means for adjusting said frictional engagement is comprised of a rotatable member threadedly connected to said shaft at said first end thereof and a washer member sandwiched between said rotatable member and the inner race of said first roller bearing, the rotation of said rotatable member in a first direction for increasing the frictional engagement between the respective inner and outer races of each of said first and second roller bearings to reduce the rotational speed of the shaft relative to the roller means, the rotation of said rotatable member in a second direction, opposite from said first direction, for decreasing the frictional engagement between the respective inner and outer races of each of the roller bearings to increase the rotational speed of the shaft relative to the roller means.

11. The apparatus according to claim 10 wherein said rotatable member is comprised of an elongated threaded bolt with an hexagonal head at one end thereof, said hexagonal head for being engaged by a wrench or the like to selectively rotate said threaded bolt inside of said shaft.

12. The apparatus according to claim 11 further including first and second hubs disposed on respective first and second ends of the shaft for mounting the apparatus on said printing press, said first hub having an internal chamber in which said first and second roller bearings and said rotatable member are disposed, said first hub being fixed against rotation and said second hub being rotatable along with said shaft.

13. An apparatus for oscillating a first rotatable member relative to a second rotatable member, said first rotatable member being concentrically disposed with respect to said second rotatable member, comprising:

roller bearing means having an inner race concentrically disposed on said second rotatable member and being in contact with said second rotatable member so as to be rotatable therewith, an outer race fixed against rotation and a plurality of tapered rollers interposed between the inner and outer races;

cam means coupled to said first rotatable member and being rotatable therewith about the axis of said second rotatable member;

cam follower means mounted on said second rotatable member and being rotatable therewith; and means for adjusting the frictional engagement between the inner and outer races to control the rate of rotation of the first member relative to the second member, said rate of rotation of said first member relative to said second member being increased with increased frictional engagement between the inner and outer races and being decreased with decreased frictional engagement between the inner and outer races, said cam means being rotatable with respect to said cam follower means at substantially said relative rate of rotation for engaging said cam follower means to oscillate said first member axially relative to said second member at a rate which is substantially the same as said relative rate of rotation.

14. A method of applying dampening fluid to selected areas of a printing plate in a lithographic printing press, comprising the steps of:

providing an apparatus having a shaft rotatable about its own axis, roller means concentrically disposed with respect to said shaft, cam means coupled to said roller means and being rotatable therewith about the axis of the shaft and cam follower means mounted on said shaft and being rotatable therewith;

disposing said apparatus in proximity to said printing plate so that said roller means is substantially in contact with said printing plate;

rotating said roller means so that said roller means applies dampening fluid to said selected areas of said printing plate; and controlling the speed of said shaft so that roller means rotates at a selected rate relative to the shaft and said cam means rotates at said selected rate relative to said cam follower means to oscillate said roller means axially relative to the shaft at a rate which is substantially the same as said selected rate, said step of controlling the speed of rotation of said shaft being comprised of the sub-steps of providing roller bearing means having an inner race concentrically disposed on said shaft and rotatable along therewith, a stationary outer race and a plurality of tapered roller bearings disposed between the inner race and outer race and selectively increasing and decreasing the compressive force on the inner race to selectively increase and decrease the frictional engagement between the inner and outer races, the speed of rotation of the shaft being inversely proportional to the frictional engagement between the inner and outer races.

15. In a lithographic printing press having a printing plate, an apparatus for applying dampening fluid to selected areas of the plate, comprising:

a shaft rotatable about its own axis;

roller means concentrically disposed with respect to said shaft, said roller means having a substantially cylindrical outer surface for contacting said printing plate to apply said dampening fluid to said selected areas when said roller means is rotated about the axis of the shaft;

cam means coupled to said roller means and being rotatable therewith about the axis of the shaft;

cam follower means mounted on said shaft and being rotatable therewith, said cam means for engaging said cam follower means to impart rotational motion from said roller means to said shaft;

means for rotating said roller means about the axis of the shaft; and means for controlling the speed of rotation of said shaft so that said roller means is rotatable at a selected rate relative to the shaft, said cam means being rotatable at said selected rate relative to said cam follower means for engaging said cam follower means to oscillate said roller means axially with respect to the shaft at a rate which is substantially the same as said selected rate, said cam means being comprised of a barrel cam having first and second oppositely positioned contoured major surfaces and said cam follower means being comprised of first and second substantially cylindrical cam followers disposed a predetermined distance apart upon said shaft for receiving the cam therebetween so that the first major surface is in contact with the first cam follower and the second major surface is in contact with the second cam follower, said first and second major surfaces for being rotated relative to the respective first and second cam followers to alternately move said roller means axially in first and second opposite directions.

16. The apparatus according to claim 15 wherein said means for rotating said roller means is comprised of a rotatable vibrator roller disposed in contact with the roller means for imparting motion to said roller means.

17. The apparatus according to claim 15 further including first and second hubs disposed at respective first and second ends of the shaft for mounting said apparatus on said print press.

18. The apparatus according to claim 15 wherein said means for controlling the speed of the shaft is comprised of roller bearing means having an inner race concentrically disposed on said shaft and being rotatable therewith, an outer race fixed against rotation and a plurality of tapered rollers interposed between the inner and outer races, and means for adjusting the compressive force between the inner and outer races, an increased compressive force for increasing the frictional engagement between the inner and outer races to decrease the speed of the shaft and increase the rate of rotation of the roller means relative to the shaft, a decreased compressive force for decreasing the frictional engagement between the inner and outer races to increase the rotational speed of the shaft and decrease the rate of rotation of the roller means relative to the shaft.

* * * * *